US005183277A

United States Patent [19]

Tang

[11] Patent Number: 5,183,277

[45] Date of Patent: Feb. 2, 1993

[54] STEERABLE ROLLER SKATE

[76] Inventor: Kuo-Tai Tang, c/o Hung Hsing Patent Service Center P. O. Box 55-1670, Taipei (10477), Taiwan

[21] Appl. No.: 699,133

[22] Filed: May 13, 1991

[51] Int. Cl.[5] ..... A63C 1/24

[52] U.S. Cl. ..... 280/11.28; 280/87.042

[58] Field of Search ..... 240/11.27, 11.28, 11.19, 240/87.042, 87.041

[56] References Cited

U.S. PATENT DOCUMENTS 200,186 2/1878 Forsyth ..... 280/11.28
328,510 10/1885 Owsley et al. ..... 280/11.28
4,149,735 4/1979 Blackburn et al. ..... 280/87.042
4,838,564 6/1989 Jarvis ..... 280/11.28

*Primary Examiner*—Richard M. Camby

[57] ABSTRACT

A roller skate includes a sole member having a steering base steerably rotatably mounted under the sole member about an axis of a bolt vertically secured to the sole member having a pair of front wheels rotatably secured to an axle transversely fixed to the steering base, and a pair of rear wheels rotatably mounted on a rear bracket secured to the sole member, whereby upon a rightward or a leftward twisting of the sole member actuated by a player's foot, the sole and the player carried by the sole will be oriented either rightwardly or leftwardly about the bolt axis so as for ensuring a safer variation of skating orientations for enhancing the player's interest.

4 Claims, 4 Drawing Sheets

STEERABLE ROLLER SKATE

BACKGROUND OF THE INVENTION

U.S. Pat. No. 4,149,735 of Ian Blackburn el al. disclosed a skateboard pivot roller which is characterized by a bracket mounted on the underside of the overhang at one end of a skateboard and is itself formed at one end with a downwardly opening socket having a large pivot roller retained therein and elevated at a height with respect to the plane of the bottoms of the skateboard wheels to provide for tilting of the skateboard itself about the wheels at the end of the skateboard proximate the pivot roller to shift at least a portion of the rider's weight to the pivot ball for performing various different maneuvers for interesting purpose.

Such a conventional skate board may increase the chances of the user suffering a sports injury as the user may fall of or sprain a joint as they tilt the board to contact the pivot ball with the ground.

The present inventor has found the drawback of the conventional skateboard of the like and invented a steerable roller skate.

SUMMARY OF THE INVENTION

The object of the present invention is to provide a roller skate including a sole member having a steering base steerably rotatably mounted under the sole member about an axis of a bolt vertically secured to the sole member having a pair of front wheels rotatably secured to an axle transversely fixed to the steering base, and a pair of rear wheels rotatably mounted on a rear bracket secured to the sole member, whereby upon a rightward or leftward twisting of the sole member actuated by a player's foot, the sole and the player carried by the sole will be oriented either rightwardly or leftwardly about the bolt axis so as for ensuring a safer variation of skating orientations for enhancing the player's interest.

DETAILED DESCRIPTION

Figure 1:
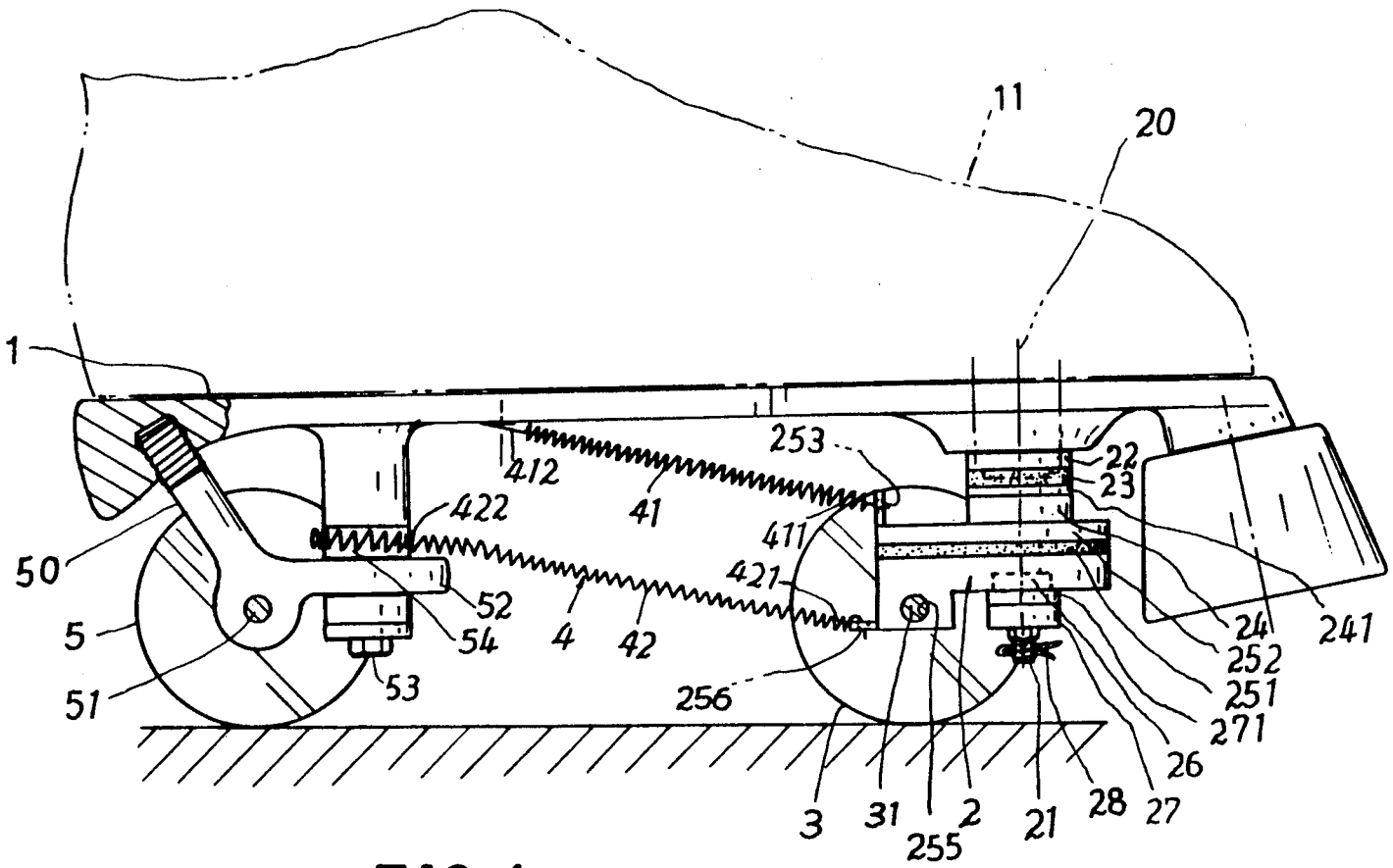
FIG. 1 is a side view illustration of the present invention.

As shown in the figures, the present invention comprises: a sole member 1 having a skate boot or strap 11 secured to the sole member 1, a steering means 2 formed on a front portion under the sole member 1, a pair of front wheels 3 rotatably secured to the steering means 2, a pair of rear wheels 5 and a tensioning spring set 4 normally tensioning the steering means 2 on the sole member 1 for a straight-forward running of the roller wheels 3, 5.

The steering means 2 includes: a front bolt 21 generally vertically secured in a front bottom portion of the sole member 1 about a front vertical axis 20 generally perpendicular to a longitudinal axis 10 longitudinally formed in a central portion of the sole member 1, a hollow stem 22 secured under the sole member 1 for passing the front bolt 21 through the hollow stem 22, a front cushioning packing 23 disposed around the front bolt 21 and retained on the hollow stem 22, an upper radial bearing 24 provided with an upper central hole 240 therein for passing the front bolt 21 for rotatably retaining an upper surface of a steering base 25 on the front bolt 21 and positioned under the front cushioning packing 23 by an upper washer 241, the steering base 25 having a central bolt hole 250 rotatably engageable with the front bolt 21 protruding downwardly through the steering base 25 and through an axial bearing 26 fixed in a socket 254 formed in a central bottom portion in the steering base 25, a lower radial bearing 27 having a lower central hole 270 for passing the front bolt 21 for rotatably securing a lower surface of the steering base 25 on the front bolt 21; and a nut 28 secured on a lowest end of the front bolt 21 for limiting the lower radial bearing 27 on the front bolt 21.

The steering base 25 further includes a base packing 251 overlain on an upper surface of the base 25, a base cover 252 covering the steering base 25 and the base packing 251, an upper spring holder 253 formed on a rear upper end portion of the base cover 252, an axle hole 255 transversely formed through the steering base 25 orthogonal to the vertical axis 20 for passing a front axle 31 through the axle hole 255 for rotatably securing a pair of the front wheels 3 on the steering base 25, and a lower spring holder 256 formed on a rear lower portion of the base 25.

A pair of the rear wheels 5 are rotatably secured on a rear axle 51, generally perpendicular to the longitudinal axis 10 of the sole member 1, transversely mounted on a rear bracket 50 secured to a rear bottom portion of the sole member 1. The rear bracket 50 also includes a rear cushioning holder 52 bifurcated from the rear bracket 50 for passing a rear belt 53 vertically secured to the sole member 1 having a rear cushioning packing 54 packed between the sole member 1 and the cushioning holder 52. The rear wheels 5 and rear bracket 5 are conventional parts which may be used in this invention.

The tensioning spring set 4 includes at least an upper tensioning spring 41 having a front spring end 411 of the upper spring 41 secured to the upper spring holder 253 formed on the steering base 25, and a rear spring end 412 secured to a bottom portion of the sole member 1, and a lower tensioning spring 42 having a front spring end 421 of the lower spring 42 secured to the lower spring holder 256 formed on the steering base 25 and a rear spring end 422 of the lower spring 42 secured to a rear bolt 53 proximate the rear wheels 5. The tensioning spring set 4 normally tensions the steering base 25 and the front wheels 3 for restoring the sole member 1 to allow the longitudinal axis 10 of the sole member 1 to be perpendicular to an axle axis 30 of the front wheels 3 for normally restoring the roller skate straight-forwardly.

The number and securing position of the tensioning springs 41, 42 are not limited in this invention.

The steering base 25 may be also formed on a rear portion of the sole member 1 for rotatably securing to rear wheels 5, if the front wheels 3 are modified to be rotatably secured directly to a front bracket (not shown) fixed on a front portion of the sole member.

The bearings 24, 26, 27 for the steering means 2 may also be modified to be other structures, such as being simplified to be a compact bearing unit (not shown) embedded in the base 25 for rotatably securing the base 25 on the front bolt 21.

The present invention may be suitably modified by those skilled in the art without departing from the spirit and scope as claimed hereinafter.

Figure 2A:
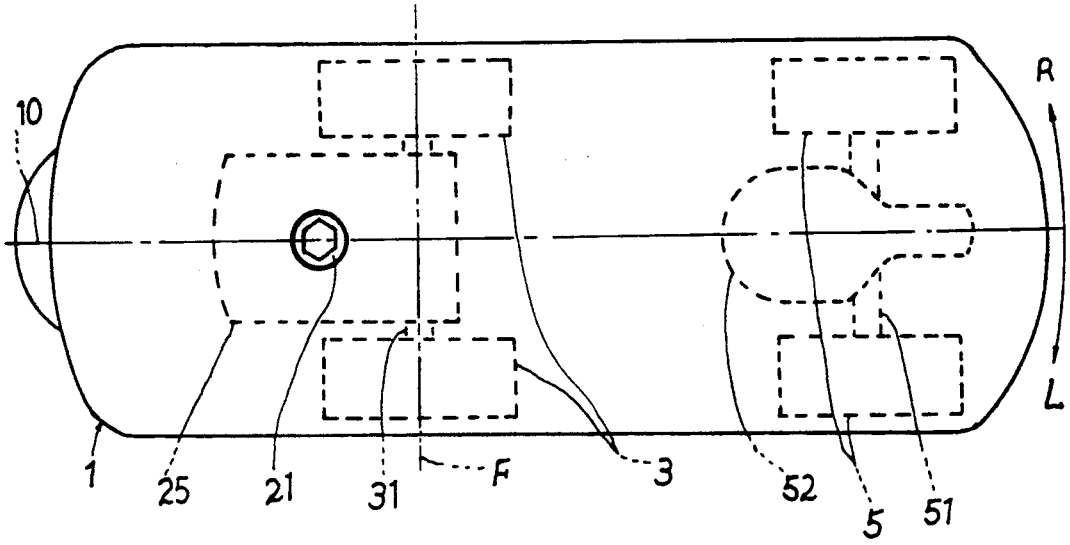
FIG. 2*a* is a top view illustration showing the variation of orientation of the present invention.
Figure 2:
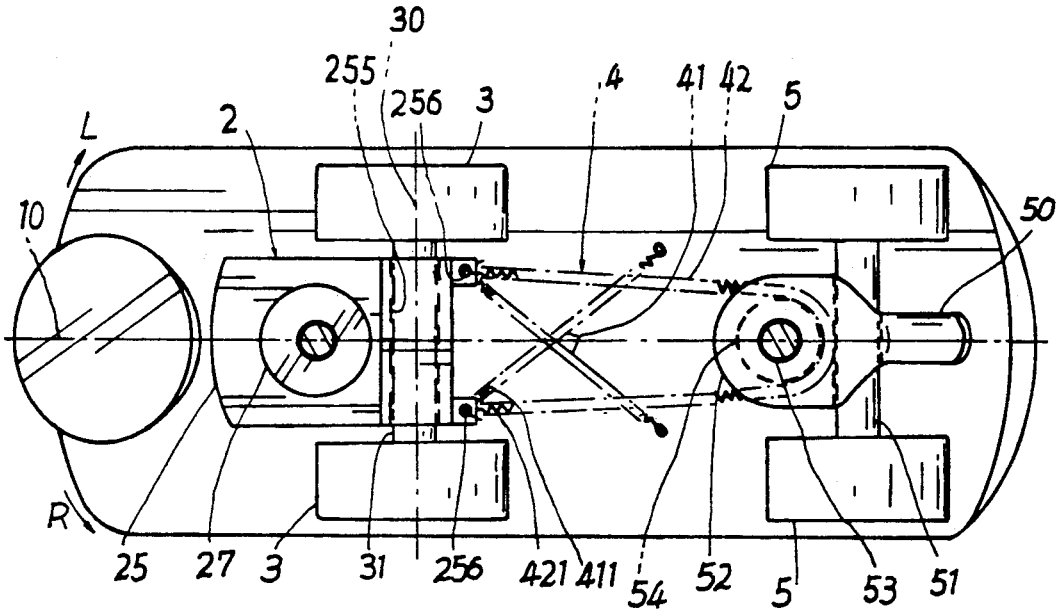
FIG. 2 is a bottom view of the present invention.
Figure 3:
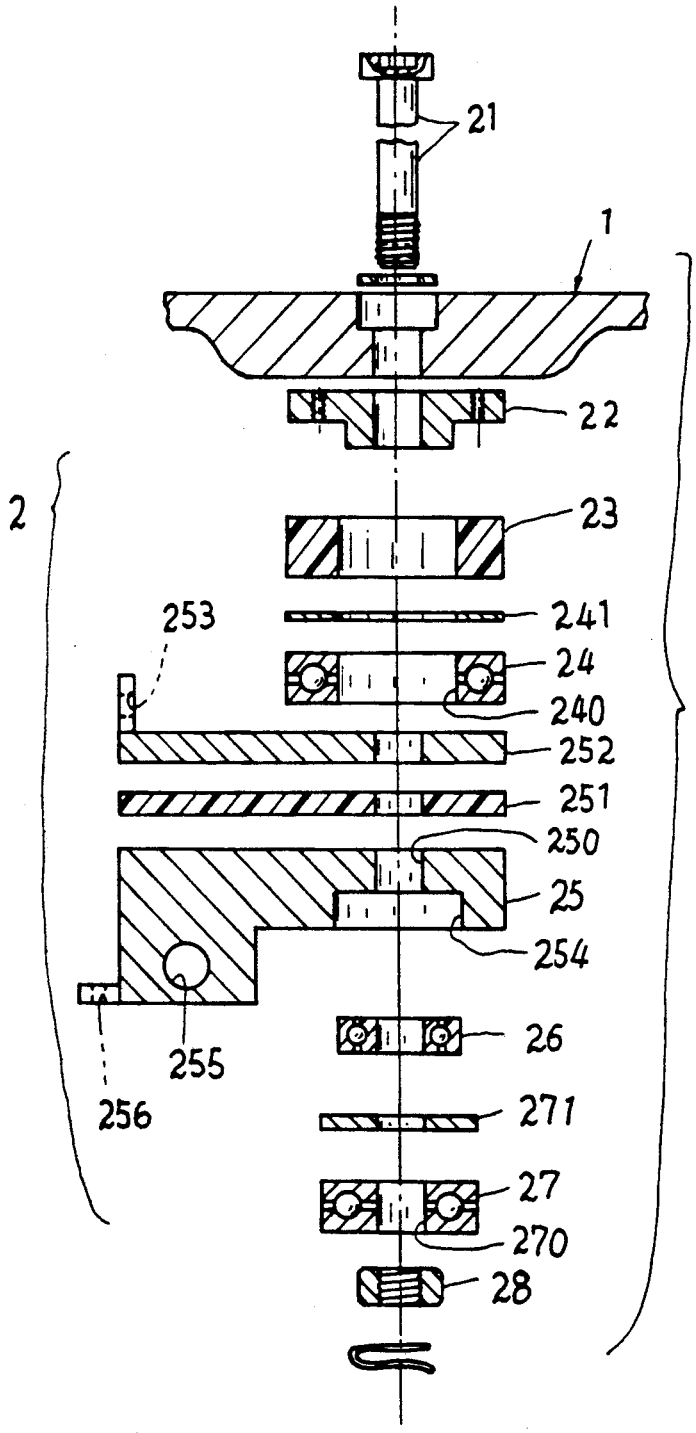
FIG. 3 is an exploded view showing major elements in construction of the present invention.
Figure 4:
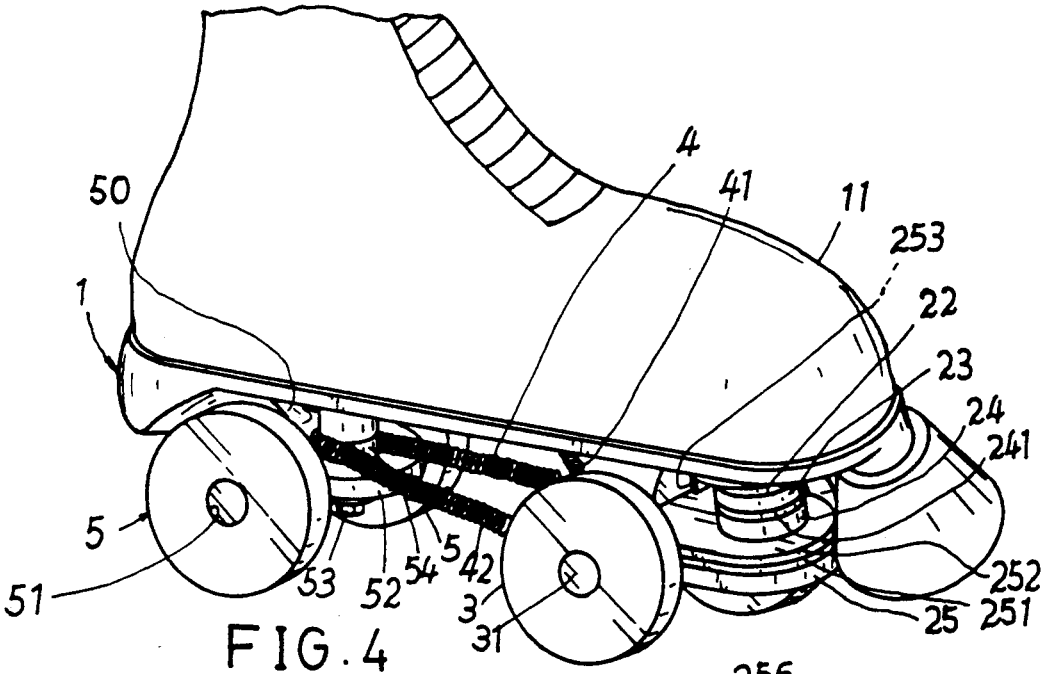
FIG. 4 is a perspective view of the present invention.

The present invention has the following advantages superior to a conventional skateboard or roller skate:

1. Just by twisting or depressing the sole member 1 by a player's foot either rightwardly R or leftwardly L (FIGS. 2, 2*a*), the skate and the player carried on the skate may then vary his or her skating orientation rightwardly or leftwardly without lifting his or her legs and skate.

2. Due to the tensioning of springs 41, 42, the direction change during a skate operation will not cause a suddenly large turning angle of the skate for preventing falling off of the player from the skate, for safely protecting the player.

3. The radial bearings 24, 27 will reduce the rotational frictional force by a player's weight, and the axial bearing 26 may reduce the resistance between bolt 21 and the base 25.

4. The steering means 2 may be provided with wheels 3 and bearings for a smooth skating and steering operation.

The present invention may also be used in a skateboard.

Figure 5:
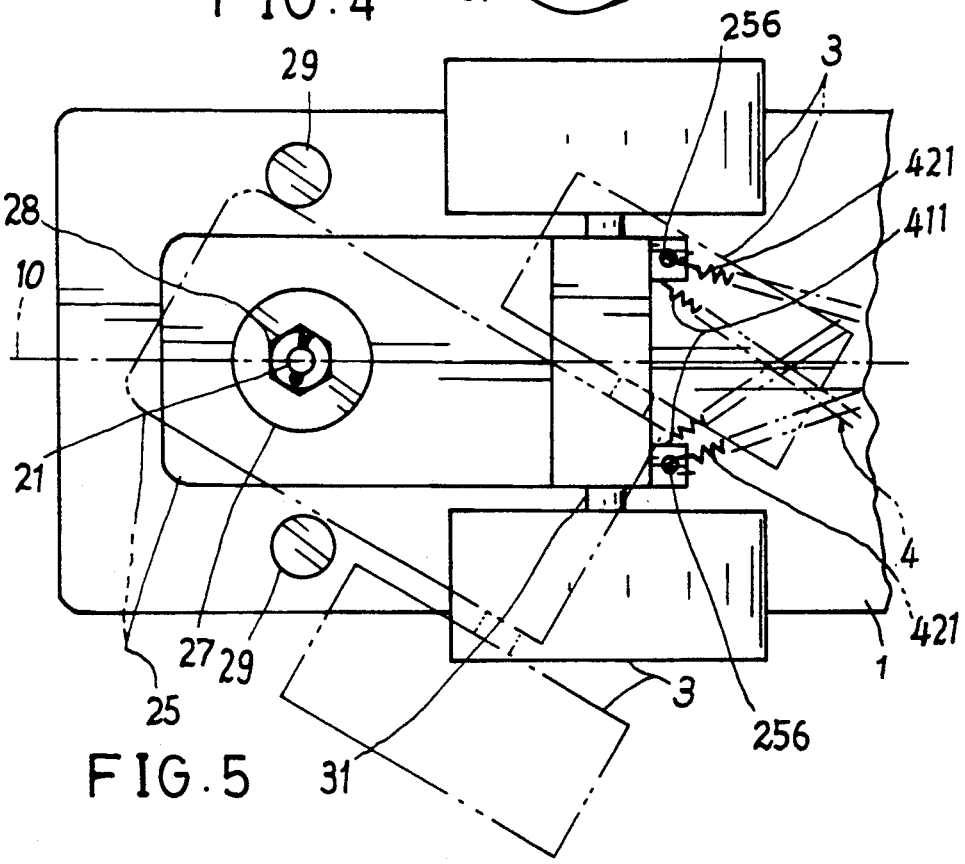
FIG. 5 shows a safety stopper of the present invention.

As shown in FIG. 5, two limiting stoppers 29 are formed on two opposite sides on the front bottom portion of the sole member 1 for limiting a large turning angle of a skate operation, such as an experimental safety angle of 30–35 degrees from the steering base 25 to either stopper 29 for ensuring a player's skate safety for preventing his falling off.

I claim:

1. A steerable roller skate comprising:

a sole member having a skate boot formed on said sole member;

a pair of rear wheels rotatably transversely secured to a rear bottom portion of said sole member;

a steering means steerably secured on a front bottom portion of said sole member;

a pair of front wheels rotatably transversely secured on said steering mean; and a tensioning spring set securing and tensioning said steering means to said sole member normally restoring said sole member and said wheels for a safety straight-forward running of a roller skate, said steering means including: a front bolt generally vertically secured in said front bottom portion of the sole member about a front vertical axis generally perpendicular to a longitudinal axis longitudinally formed in a central portion of the sole member, a hollow stem secured under the sole member for passing the front bolt through the hollow stem, a front cushioning packing disposed around the front bolt and retained on the hollow stem, an upper radial bearing provided with an upper central hole therein for passing the front bolt for rotatably retaining an upper surface of a steering base on the front bolt and positioned under the front cushioning packing by an upper washer, the steering base having a central bolt hole rotatably engageable with the front bolt protruding downwardly through the steering base and through an axial bearing fixed in a socket formed in a central bottom portion in the steering base, a lower radial bearing having a lower central hole for passing the front bolt for rotatably securing a lower surface of the steering base on the front bolt; and a nut secured on a lowest end of the front bolt for limiting the lower radial bearing on the front bolt.

2. A steerable roller skate according to claim 1, wherein the steerig base includes a base packing overlain on an upper surface of the base, a base cover covering the steering base and the base packing under the base cover, an upper spring holder formed on a rear upper end portion of the base cover, an axle hole transversely formed through the steering base orthogonal to the front vertical axis for passing a front axle through the axle hole for rotatably securing said pair of the front wheels on the steering base, and a lower spring holder formed on a rear lower portion of the steering base.

3. A steerable roller skate according to claim 1, wherein said tensioning spring set includes at least an upper tensioning spring having a front spring end of the upper spring secured to an upper spring holder formed on a base cover located in said steering means, and a rear spring end secured to a bottom portion of the sole member, and a lower tensioning spring having a front spring end of the lower spring secured to a lower spring holder formed on the steering base and a rear spring end of the lower spring secured to a rear bolt fixed to the sole member proximate the rear wheels.

4. A steerable roller skate according to claim 1, wherein said steering means includes two limiting stoppers formed on two opposite sides of the steering base on said front bottom portion of the sole member for limiting a turning angle of said steering base about said front bolt.

* * * * *